US005253819A

United States Patent [19]

Butler, Jr.

[11] Patent Number: 5,253,819

[45] Date of Patent: Oct. 19, 1993

[54] SPEED MATCH SPLICING METHOD AND APPARATUS

[75] Inventor: Richard A. Butler, Jr., Marion, Mass.

[73] Assignee: Butler Automatic, Inc., Canton, Mass.

[21] Appl. No.: 854,224

[22] Filed: Mar. 20, 1992

Related U.S. Application Data

[63] Continuation-in-part of Ser. No. 754,821, Sep. 4, 1991.

[51] Int. Cl.[5] ..... B65H 19/16

[52] U.S. Cl. ..... 242/58.3; 156/504

[58] Field of Search ..... 242/58.3, 58.1, 58.4; 156/504

[56] References Cited

U.S. PATENT DOCUMENTS

| | | | |
|---|---|---|---|
| 1,788,648 | 1/1931 | Wood | 242/75.1 |
| 3,103,320 | 9/1963 | Huck | 242/58.3 |
| 3,223,339 | 12/1965 | Justus et al. | 242/58.3 |
| 3,253,795 | 5/1966 | Penrod et al. | 242/58.2 |
| 3,391,877 | 7/1968 | Angell et al. | 242/58.3 |
| 3,813,053 | 5/1974 | Butler, Jr. et al. | 242/58.4 |
| 3,990,647 | 11/1976 | Clifford | 242/58.1 |
| 4,077,580 | 3/1978 | Lang et al. | 242/58.3 |
| 4,116,399 | 9/1978 | Mosburger | 242/58.4 |
| 4,262,855 | 4/1981 | Haag | 242/58.1 |
| 4,278,213 | 7/1981 | Rubruck | 242/75.1 |
| 4,281,803 | 8/1981 | Massey | 242/58.1 |
| 4,339,093 | 7/1982 | Shanklin et al. | 242/58.6 |
| 4,390,388 | 6/1983 | Nagata et al. | 156/351 |
| 4,543,152 | 9/1985 | Nozaka | 242/58.2 |
| 4,575,016 | 3/1986 | Pali | 242/58.1 |
| 4,715,922 | 12/1987 | Hayashi et al. | 156/361 |
| 4,722,489 | 2/1988 | Wommer | 242/58.4 |
| 4,859,270 | 8/1989 | Martin et al. | 156/361 |

FOREIGN PATENT DOCUMENTS

| | | |
|---|---|---|
| 48-6566 | 2/1973 | Japan . |
| 48-51401 | 7/1973 | Japan . |
| 54-172476 | 12/1979 | Japan . |
| 58-89547 | 5/1983 | Japan . |
| 63-56143 | 6/1988 | Japan . |

*Primary Examiner*—Daniel P. Stodola
*Assistant Examiner*—John Q. Nguyen
*Attorney, Agent, or Firm*—Mark J. Patterson; Edward D. Lanquist, Jr.; I. C. Waddey, Jr.

[57] ABSTRACT

A web splicing method and apparatus to splice a running web to the web on a ready roll so as to avoid web speed and position mis-matches due to roll eccentricity and roll end wobble. After an adhesive splicing medium is applied to the leading end of the web on the ready roll, that roll is accelerated to a selected nominal splicing speed. The roll surface speed and end edge position are then measured at least at a location at or near the splicing medium thereon. The speed and edge position of the running web are also measured. During successive revolutions of the roll, the running web speed and the roll surface speed in the vicinity of the splicing medium are compared to produce speed difference signals which are applied to control the speed of the running web and/or the roll to match the speed of the running web and the surface speed of the roll at or near the splicing medium. Also, the edge positions of the running web and the roll end at or near the location of the splicing medium are compared to produce edge position difference signals which are applied to shift the lateral position of the running web and/or the roll to achieve a web edge position match between the running web and the web roll at or near the splicing medium. After the webs are matched thusly in speed and position, the splice is made between the two webs.

2 Claims, 3 Drawing Sheets

SPEED MATCH SPLICING METHOD AND APPARATUS

RELATED APPLICATION

This application is a continuation-in-part of Ser. No. 754,821, filed Sep. 4, 1991.

BACKGROUND OF THE INVENTION

This invention relates to the splicing of webs from a succession of web rolls while the webs are in motion so that web can proceed uninterruptedly to a web consuming machine, such as a printing press. It relates more particularly to a method and apparatus for closely matching the speeds and positions of the webs being spliced at the time of the splice.

The providing of an uninterrupted supply of web is important in many industries, particularly in the printing industry. Today's high speed printing presses print on web, i.e. paper, cloth, etc., drawn from a roll rotatably supported by a roll stand located upstream of the press. In order to avoid having to shut down the press each time a web roll expires, a splicing mechanism is invariably incorporated into the roll stand to enable the trailing end of the expiring web to be spliced to the leading end of the web on a new roll.

Modern day presses can turn at very high speeds and thus they consume web at a high rate, e.g. in excess of 2000 feet per minute (fpm). Consequently, in order for the printing operation to proceed with maximum efficiency, it is essential that the splicing of one web to another occur in a minimum amount of time and with a minimum wastage of web.

It is also critical that each splice be made and be essentially perfect to avoid large tension upsets and downstream web jams which can cause a web break, necessitating stoppage of the press or other web consuming machine.

Speed match splicing of one web to another can be accomplished at line speed, i.e., the speed of the press or other web consuming machine, or at some lesser speed. In the former case, prior to making a splice, the ready or fresh roll, which may be supported on a rotatable turret, is accelerated so that its surface speed substantially matches the speed of the running web which travels at a selected line speed. When splicing at a lesser speed, the new or ready roll is accelerated to a selected speed less than line speed and the running web is decelerated to that speed in anticipation of the splice. In both cases, just before the running roll expires and when the speeds of the two webs are ostensibly matched, the splice is made between the trailing end of the running web and the leading end of the web on the ready roll. In the latter case, after the splice, the ready roll is accelerated up to line speed and during the time the running web roll was slowed, the web consuming machine draws web from a web store such as a festoon or accumulator located between the splicer and the web consuming machine. That web accumulator is refilled with web following each splicing operation.

In speed match splicers such as this, prior to each splicing operation, the leading end of the web on the ready roll must be prepared for the splice. Such preparation involves trimming the leading end of the web on the ready roll so that it is straight, V-shaped or W-shaped depending upon the size of the roll, and temporarily "tacking" that end to the underlying web convolution on the roll by means of short adhesive strips spaced along the leading end of the web and oriented perpendicular thereto. The tacking of the leading end to the remainder of the roll can also be accomplished with appropriate releasing adhesive spots applied to the undersurface of the leading edge margin of the web.

The splice preparation procedure invariably also involves the application of a straight, V-shaped or W-shaped double face splicing tape to the leading edge margin of the web on the ready roll. That adhesive presents a sticky or tacky surface to the running web. In lieu of tape, adhesive lines or spots may also be used for this purpose.

In the typical speed match splicer, the actual splice is effected by pressing the running web momentarily against the surface of the ready roll at the adhesive area thereon after the running web and the ready web roll surface have been speed matched as noted above. The two webs become pasted together or spliced as soon as the splicing tape or adhesive area is rotated into engagement with the running web. Immediately thereafter, a knife is actuated to sever the running web just behind the splice, thereby separating the running web from its nearly empty roll core, leaving the ready roll to supply the continuing needs of the web consuming machine.

While the above-described prior splicers have operated satisfactorily at reasonably high press speeds, i.e., up to 2000 fpm, as these speeds approach 3000 fpm, certain problems manifest themselves, many of which are traceable directly or indirectly to the techniques used heretofore for measuring the relative speed and position of the two webs being spliced to effect the speed and position matches prior to splicing.

More particularly, the speed and position of the running web are usually more or less constants because the web is being drawn under tension within the press or other machine which runs at a fixed line speed. The speed of that web can be monitored accurately, e.g., by a tachometer or shaft encoder responding to the surface speed or angular velocity of a fixed diameter guide roller around which that web is trained. However, monitoring the speed of the ready web prior to splicing is another matter altogether. The speed of the ready web at that time is actually the surface speed of the ready web roll because, prior to the actual paste of the two webs, the leading edge margin of the ready web is "tacked" to the underlying web convolution on that roll as noted above.

Conventionally, the surface speed of a ready web roll may be monitored by a tachometer rotated by a follower wheel which rides on the surface of the ready roll as that roll rotates. The signals from the tachometer may be compared with the signals from the guide roller tachometer which monitors the surface speed of the running web to produce a speed difference signal. This difference signal can be used to speed up or slow down the ready web roll if the speed of the running web is the speed reference. Alternately, the difference signal can be applied to regulate the speed of the running web if the ready roll speed is used as the reference. However, the use of a tachometer wheel results in there being a gap in the splice to the running web. That is, conventionally a gap is provided in the adhesive tape or area at the leading edge of the ready web to provide clearance for the tachometer wheel. This is to prevent the wheel from sticking to the adhesive and to prevent the wheel from bouncing were it to encounter the edge of the adhesive tape.

In those splicers which use roll surface-engaging accelerating belts to accelerate the ready roll, the surface speed of the ready roll may also be monitored by a tachometer which measures the speed of the belts. Here again, however, gaps in the splicing tape or area are present to provide non-adhesive areas where the belts engage the web roll.

In both of the above splicers, the presence of such adhesive gap(s) results in there being gap(s) in the splice to the running web. Resultantly, after splicing, as the web travels at high speed through the press, windage at the surface of the web can lift the leading edge of the former ready web at the splice gap(s) so that that edge tends to catch or jam in downstream printing couples, causing damage to the rollers and/or a web break.

Also, a roll of web is hardly ever a perfect cylinder; it has surface bumps and eccentricity. For example, it is not unusual for, say, a 50 inch diameter web roll to be out of round by as much as ½ inch. Therefore, if that roll is rotated at a fixed angular velocity, the surface speed at the high point on the roll will be appreciably greater than the surface speed at the low point thereon. For the above roll, this translates to a 1–2% speed difference or variation at the roll surface.

Therefore, a wheel or belt-driven tachometer really measures the average surface speed of the ready web and, conventionally, it is that average speed that is compared to the running web speed to achieve a so-called speed match. In actuality, however, the surface speed of the web roll where the paste to the running web is actually made, i.e., at the web edge margin carrying the splicing tape or adhesive area, may be appreciably different from that detected average speed. As a consequence, when the paste is made, there may be an appreciable web speed mis-match, i.e., in the above example of as much as 1–2%, depending upon where the tape is located around the roll axis. While such poor accuracy can be tolerated at lower web speeds, it cannot at web speeds approaching 3000 fpm. At those higher speeds, a speed mis-match of that size can result in a missed splice or a wrinkled or otherwise defective splice which can damage downstream printing couples and/or cause a web break.

The surface speed of a web roll may also be determined by measuring the angular velocity of the roll using a shaft encoder operatively connected to one of the chucks supporting the web roll. Multiplying that angular velocity and the radius of the roll yields the surface speed of the roll. However, as just described, the roll radius may vary around the axis of the roll due to irregularities in the roll. Conventional techniques for measuring roll radius, actually measure the radius of the highest point around the roll axis or perhaps the average radius (i.e., the average of the highest and lowest points around the roll axis). Thus, that measurement does not necessarily reflect the radius of the roll at the location where the splice is to occur, i.e., at the web leading edge margin carrying the splicing tape or adhesive area. Therefore, that speed measuring technique has the same disadvantages noted above in terms of defective and missed splices at high web speeds.

While a missed splice may not seem to be a particularly momentous event, it should be bourne in mind that for press speeds around only 2000 fpm, the press industry has calculated that, on average, 1% of the splices are missed and that each missed splice costs in the order of $400.00 due to web wastage and downtime. Obviously, at higher speeds, the number of misses and the monetary loss would be even more. Therefore, a splicer with the ability to reduce the number of splice misses by only 0.5% would be considered extremely important to the industry.

When splicing two webs, it is also important that the lateral positions of the webs be matched; i.e., the corresponding side edges of the two webs should be aligned. The usual procedure for accomplishing this is to monitor the edges of the running web and the ready web roll using known optical, mechanical or pneumatic web edge sensors. Then, with one of the webs being the reference, a difference signal is developed and applied to control the lateral position of the carriage supporting the roll letting of the other web until the two webs are aligned.

Here again, this procedure does not take into account the fact that a web roll is hardly ever a perfect cylinder. It may be racked such that its ends are not exactly perpendicular to the roll axis. Consequently, when the roll is rotated, its ends may wobble. For a web roll 50 inches in diameter, the wobble can be as much as ±3/16 inch. Therefore, when the edge of the web roll is being sensed for web alignment purposes, the sensor will actually measure an average roll edge position which may or may not be the actual position of the roll edge where the splice is made to the running web, i.e., at the splicing tape or adhesive area on the ready roll. For example, if the leading end of the ready web and splicing tape thereon are at the laterally outermost position o the tilted end of the roll and the matching of the web positions is based on the average lateral position of the roll, when the leading end of the ready web is actually pasted to the trailing end of the running web, the side edge of that leading end may project laterally beyond the corresponding edge of the running web by as much as one-half of the roll end wobble. Such a projecting edge margin will extend outside the normal web running zones on downstream web guide rollers and pick up high tack ink residue that can jam in downstream printing couples causing roller damage, web tension upsets and/or a web break.

It would be desirable, therefore, if there existed a technique for measuring the speed and lateral position of a web roll so as to achieve a more or less exact web speed match and web edge position match at the instant of the paste or splice of a ready web to a running web. This would make it possible to minimize the incidence of defective and missed splices and web misalignments that typically cause problems in downstream web consuming machines, such as high speed presses.

SUMMARY OF THE INVENTION

Accordingly, the present invention aims to provide a web splicer which can make good speed match splices between a ready web and a running web over a wide range of web speeds between a speed somewhat greater than line speed and a speed less than line speed.

Another object of the invention is to provide a splicer which can achieve an excellent speed match between the two webs being spliced at the instant of the actual splice or paste.

Still another object of the invention is to provide a speed match splicer which determines the surface speed of a ready web roll in such a way as to achieve a speed match between the ready web and a running web at the actual location of the splice.

Yet another object of the invention is to provide a splicer which can, even at high web speeds, laterally align the two moving webs being spliced quite accurately at the instant of the splice.

A further object of the invention is to provide a speed match splicer which obtains a superior splice by measuring and controlling the relative speed and relative lateral position of the webs at the actual location of the splice.

Yet another object of the invention is to provide a method of splicing together fast-moving webs in a very precise manner even at high web speeds to optimize the splice.

Another object is to provide a method of splicing webs at high web speeds which minimizes the incidence of missed and defective splices.

Still another object of the invention is to provide a method of splicing a ready web to a running web which produces one or more of the above advantages.

The invention accordingly comprises the several steps and the relation of one or more of such steps with respect to each of the others and the apparatus embodying the features of construction, combination of elements, and arrangement of parts which are adapted to effect such steps, all as exemplified in the following detailed description, and the scope of the invention will be indicated in the claims.

Briefly, the invention may be implemented in a turret splicer similar to the one disclosed in my copending application Ser. No. 695,705, filed May 3, 1991, the contents of which is hereby incorporated by reference herein. It should be understood, however, that certain aspects of the invention also have application to conventional types of speed match splicers which splice at line speed or at some greater or lesser speed.

The present splicer implementation supports web rolls on roll chucks at opposite first and second ends of the splicer turret. The turret can be rotated to position the chucks at each end of the turret at a roll loading position close to the floor, the chucks a the opposite end of the turret then being in a roll running position elevated above the floor. When a web roll is in its elevated running position, web from that roll is conducted past a splicer head and through a web accumulator to a downstream web-consuming machine, such as a printing press.

While web is being withdrawn from that roll at a selected speed which may be line speed or a speed greater or less than line speed, the leading edge of the web on a ready roll may be prepared by trimming that edge so that it follows a straight line, a V, a W or some other such course to minimize the effects of windage on that edge. Then that edge is tacked to the underlying web convolution of that roll. Also, a strip of double-face adhesive tape or adhesive lines or spots may be applied to the leading edge margin of that web. Prior to the expiration of the running roll, the ready roll, prepared as aforesaid, is engaged by the chucks at the second end of the turret.

When the running roll reaches a selected minimum diameter, a splice cycle is initiated which results in the leading end of the web on the ready roll being pasted to the trailing end of the web from the running roll so that the web consuming machine now draws its web requirement from the ready roll.

This process is repeated when the roll at the second end of the turret, now the running roll, has unwound to a selected diameter. The turret is again rotated to position the first end of the turret at its loading position, the empty roll core is removed from the chucks at that end and a new roll is prepared and loaded onto the first end of the splicer to await depletion of the web from the running roll at the second end of the turret, at which point another splicing operation takes place. This process is repeated so that web can proceed uninterruptedly to the web consuming machine.

If the speed of the running web is reduced in order to effect the splice between the two webs at a speed less than line speed, the web stored in the accumulator can be drawn down to supply the needs of the web consuming-machine so that a substantially constant line speed can be maintained. The accumulator is also sensitive to changes in the tension of the web and, therefore, it is normally used to provide control signals for braking the running web roll so as to minimize tension upsets, as is well known in the art.

During the splice sequence described above, prior to making the actual paste of the webs, the ready roll is accelerated so that its surface speed matches the speed of the running web, which speed may be line speed or a selected speed greater or less than line speed.

In accordance with this invention, the roll is accelerated and the speed match is achieved without having to contact the surface of the ready roll with accelerator belts, tachometer wheels and the like. Therefore, the splicing tape or adhesive can extend the full widths of the webs being spliced so the resulting splice will be completely devoid of gap which is quite advantageous from a marketing standpoint. As will be described in more detail later, the ready roll is actually accelerated using special cone drives which controlledly contact the opposite ends of the roll. Further, the speed match is achieved, not by matching the running web speed to the average speed of the ready roll or to the surface speed at some arbitrary location on that roll as was done heretofore, but rather by matching the running web speed to the surface speed at the exact location on the roll where the splice to the running web will take place, i.e., at the leading edge margin of the ready web where the splicing tape or adhesive is located.

For this, means are provided for detecting the splicing tape or adhesive or some marking at or near the location of that tape or adhesive on the roll. Further as the ready roll is being accelerated to the speed at which the splice to the running web will take place, the speed of the ready roll is monitored, as is the position of the tape about the roll axis, i.e., its phase angle. When comparing the surface speed of the ready roll and the running web speed to achieve a speed match, only the surface speed of the roll at the location of the splicing tape is considered.

The surface speed of a rotating ready roll may be determined in a variety of different ways. For example, as noted above, it may be measured by a surface-engaging tachometer wheel or by measuring the surface speed of roll surface-engaging accelerator belts. However, to avoid undesired gaps in the splice as discussed above, a preferred method is to measure the time it takes for a roll surface portion of known circumferential extent to pass a fixed reference point ($v=s/t$). This may be done by detecting the leading and trailing edges of the splicing tape or by detecting a bar coded label or markings near the splicing tape or adhesive. Another preferred technique is to measure the angular velocity of the roll and multiply that by the roll radius ($s=r\Theta'$). However, it is a feature of this invention that measurement method is used, only the measurement at the location on the roll surface where the splice will take place is used for comparison with the running web speed to achieve a speed match.

More specifically, during each revolution of the ready roll, some indicium on the roll surface at or near the splicing tape is detected and used to define a roll speed measurement window during each revolution of the roll. Only the speed measurements taken in that window are compared with the speed of the running web to develop the speed difference signal indicative of a speed mismatch. That difference signal may then be applied to brake or accelerate one web or the other until the web speeds are exactly the same. Preferably, the speed of the running web is matched to that of the ready web for reasons discussed in the above-identified parent application.

It will be apparent from the foregoing that with my speed measurement technique, it matters not that the ready web roll is eccentric and it is irrelevant where the splicing tape is located about the roll axis. Since only the ready roll surface speed at the splicing tape or adhesive is used for comparison with the running web speed, there will always be a perfect speed match where and when the actual paste is made between the two webs.

In accordance with this invention, the same basic principle is used to precisely match the side edge of a new web on a ready roll to the corresponding edge of a running web from a depleting roll core at splice time. Instead of measuring the average lateral position of the end face of the ready roll as it rotates and comparing that with the edge position of the running web to align the two webs for splicing as was done heretofore, only the lateral position of the roll end face at a small sector of the roll under the splicing tape is used for comparison with the edge position of the running web. From that comparison, an edge position difference signal may be produced to shift the lateral position of the carriage supporting the ready roll or the roll from which the running web is being drawn to bring the web edges into perfect alignment where the actual splice between the two webs will take place, i.e., at the splicing tape or adhesive on the ready roll. Therefore, the fact that the ready web roll has a substantial end face wobble will not prevent there being perfect edge alignment of the two webs at the time and place of splicing.

My splicer is thus advantaged in that it can splice a running web to web on a ready roll quickly and reliably by assuring a web speed match at instant of the splice even though the ready roll may be out of round. The splicer also assures that the two webs are in edge alignment at the instant of the splice even though the ready roll may be racked so that its end faces are not perpendicular to the roll axis. Both of these features enable the splicer to minimize the incidence of missed splices and tension upsets and downstream damage in presses or other web consuming machines associated with the splicer. The splicer also has other features which will be described in detail later that combine to optimize the splicing procedure.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

Figure 1:
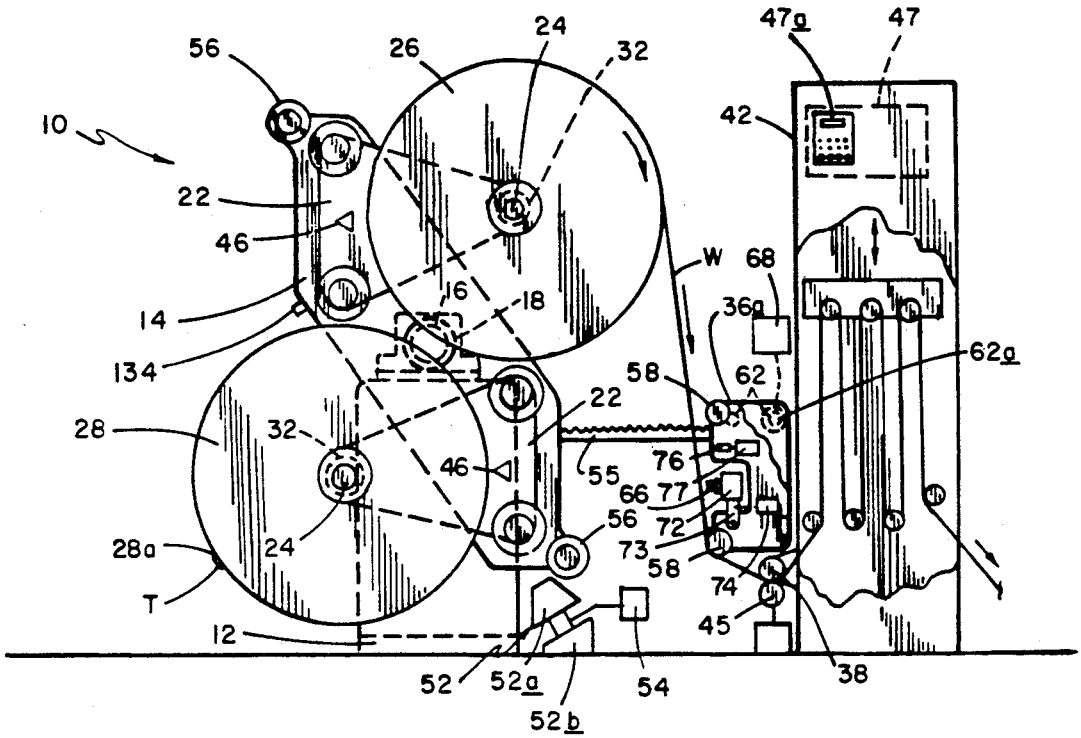
FIG. 1 is an elevational view with parts broken away showing a turret splicer embodying my invention with the splicer turret shown in its normal running position.

Refer now to FIG. 1 of the drawings which shows my splicer generally at 10. The splicer includes an upstanding support 12 which supports a turret 14 which is pivotally connected to the upper end of the support by a journaled axle 16. The turret may be rotated by a motor 18 between a normal running position shown in FIG. 1 wherein the turret is more or less vertical and a splicing position shown in FIG. 2 wherein the turret is generally horizontal. A pair of carriages 22 are mounted to the opposite ends of turret 14. Each carriage carries a pair of chucks 24 for supporting the opposite ends of a roll of web. Thus, the upper chucks 24 in FIG. 1 support a web roll 26, denominated the running roll, whereas the lower chucks 24 in that figure are shown as supporting a roll 28, denominated the ready roll. Actually, a full roll 28 should not be present at the lower turret position in FIG, 1; it is shown to enable an orderly description. The chucks at that position would normally carry a depleted roll core from a previous splicing cycle of the splicer.

The angular velocity of the web rolls at both roll locations may be controlled by brakes 32 coupled to the associated roll chucks. Since the splicer achieves a speed match by controlling the speed of the running roll as will be described, pneumatic brakes with fast response pneumatic servo valves in close proximity to the brakes may be used. These have a much faster response than the DC drives and variable frequency drives used in prior splicers which speed match by controlledly driving the ready roll.

Web W drawn from the running roll 26 is conducted past a splicing head 36 and under a idler roller 38 to a more or less conventional web accumulator 42 which stores a supply of web and contributes to web tension control as is well known in the art. Web from accumulator 42 is conducted to a press or other web consuming machine (not shown) which usually consumes web at a selected fixed rate. The speed of the running web W drawn from the roll 26 may be monitored by suitable means such as a shaft tachometer 44 operatively coupled to idler roller 38, as shown in FIG. 2.

As will be described in more detail later, in some cases it may be desirable to accelerate the running web W downstream from head 36. Accordingly, a motorized drive roller 45 may be provided opposite roller 38, with web W passing through the nip of the two rollers. Actually, rollers 38 and 45 would normally be arranged relative to the web path to provide a greater web wrap around the rollers to minimize web slippage. Accelerating the running web by a downstream accelerator roll is preferable to doing that using D.C. drives coupled to the running roll chucks in the manner of some prior splicers.

Figure 2:
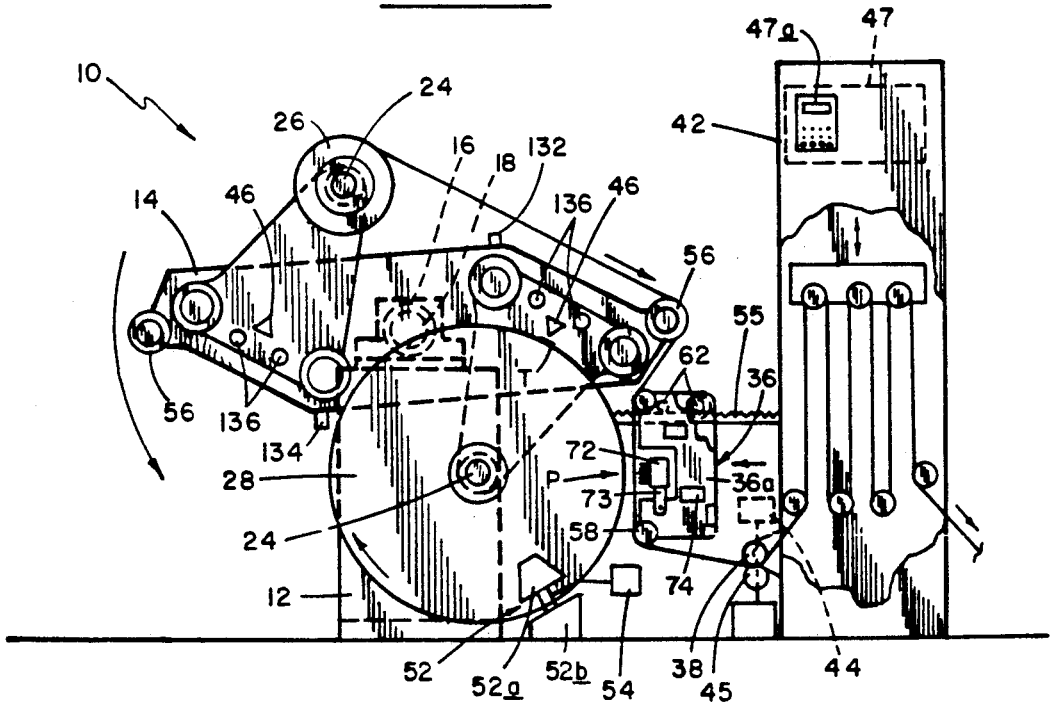
FIG. 2 is a similar view of the splicer showing the turret in its splicing position.
Figure 3:
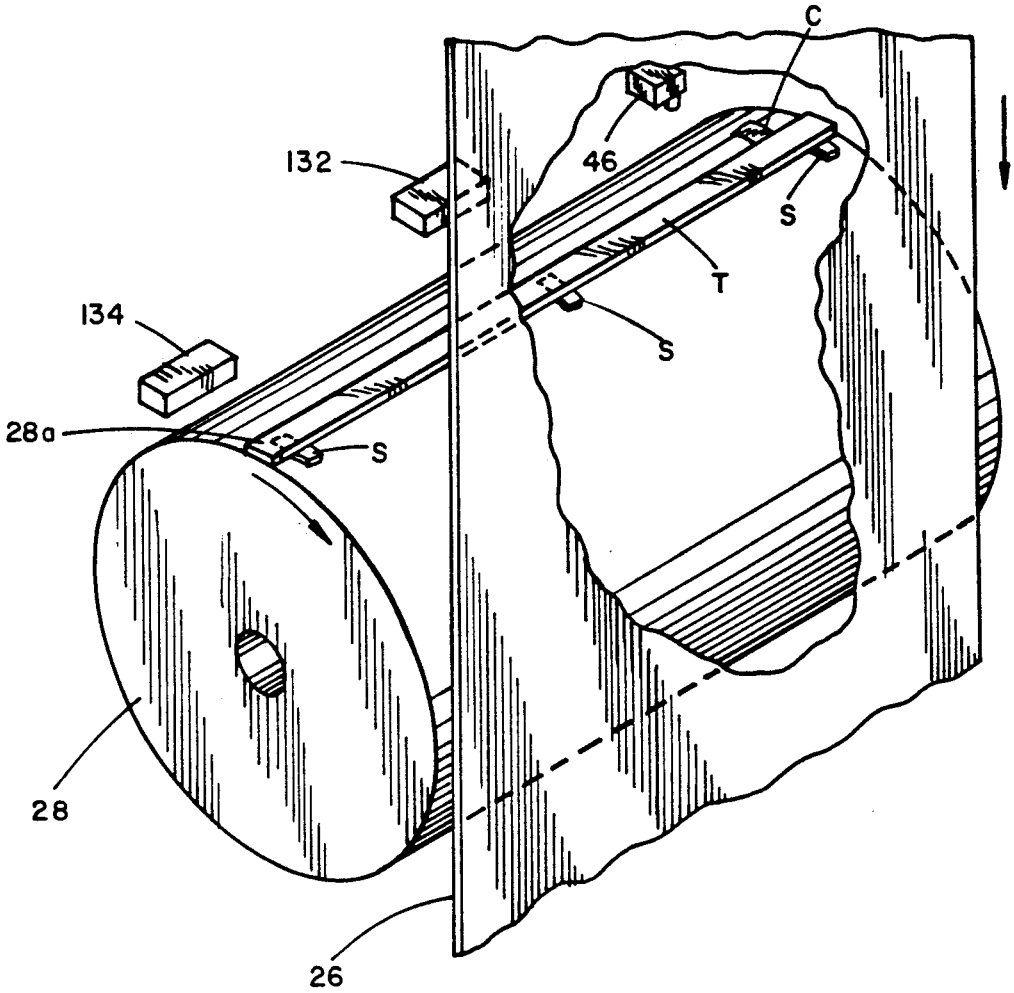
FIG. 3 is a diagrammatic view of a ready web roll with its leading end prepared and about to be spliced to a running web in the FIG. 1 splicer.

As shown in FIGS. 2 and 3, while web is being drawn from roll 26, the ready roll 28 (shown already loaded in FIG. 2) is prepared by trimming the leading edge 28a (FIG. 3) of the web on that roll and tacking that edge to the underlying roll convolution using conventional tape strips S or adhesive spots (not shown). Also, a strip of double faced tape T is applied to that leading edge margin as part of the preparation procedure. The roll 28 shown in FIG. 3 has a straight leading edge 28a and a straight splicing tape T. On larger rolls, edge 28a and tape T may be V-shaped or W-shaped. In any event, the splicer includes a detector 46 which "looks" at the surface of the ready roll and detects the passage by the detector of the tape T or equivalent adhesive or some other peripheral marking on the surface of the roll at or near the tape. Preferably, detector 46 looks at the sector of the roll at splicing location P or optical fibers lead from the detector aperature to a location at the splicing location P in FIG. 2 so that the detector may sense the tape T or equivalent right at that location.

The outputs of the detector and tachometer 44 are applied to a controller 47 which controls all aspects of the splicer and, in the illustrated apparatus, is mounted to accumulator 42.

At some time when the roll 26 nears depletion, turret 14 is rotated by motor 32 to its splicing position shown in FIG. 2. This positions the lower chucks 24 on the splicer turret close to the floor. This is the position at which roll 28 is actually engaged by those chucks and at this position, roll 28 is disposed between a pair of accelerators 52. Each accelerator, described in detail in the above-identified application, Ser. No. 695,705, includes a conical driver 52a which is rotated by a motor 52b. The accelerators, or at least their drivers 52a, can be moved into and out of engagement with the opposite ends of roll 28. Thus roll 28 can be rotated by engaging and rotating the drivers.

In accordance with the invention, means are provided for monitoring the rotation of a ready roll at both positions on the turret, i.e. the angular velocity and phase of that roll. This may be done by shaft encoders coupled to the chucks 24. More preferably, however, this is accomplished by means of an encoder 54 which monitors the rotation of one or each of the accelerator drivers 52a. This is because it takes about five revolutions of the driver 52a to rotate the ready roll 28 through one revolution. Therefore, encoder 54 has five times the resolution of a similar encoder mounted directly to the roll chucks 24.

Splicer head 36 normally reposes in a retracted position shown in FIG. 1 wherein it is spaced away from turret 14. When turret 14 is in its splicing position as shown in FIG. 2, the splicing head 36 may be moved on rails 55 to an advanced position shown in FIG. 2 in which it is located close by the periphery of ready roll 28. To guide the web W, Idler rollers 56 are mounted to opposite ends of turret 14. Additional idler rollers 58 are mounted between the side plates 36a of the splicer head at the forward corners thereof to guide web W so that a vertical stretch of that web between rollers 58 is closely spaced from the periphery of roll 28 when the splicer head 36 is in its advanced position shown in FIG. 2.

Any suitable means may be provided to move splicer head 36 between its retracted and advanced positions. For example, the rails 55 may be formed as racks and the splicer head may be fitted with rotary pinions 62 which engage the racks and are moved therealong by suitable means such as gear motors 62a.

Since the ready roll 28 may have various diameters, the splicer head 36 may have to travel various distances along rails 58 from its retracted or home position shown in FIG. 1 to reach its FIG. 2 advanced position for a particular roll 28. To determine the distance travelled, an optical detector 66 is mounted to the splicer head beyond the ends of roll 28. The detector comprises a light source and a light sensor positioned on the splicer head beyond the opposite ends of roll 28 and arranged to sight along that roll. The splicer head is moved from its retracted position shown in FIG. 1 to its advanced position shown in FIG. 2 until the periphery of the roll 28 intercepts the light beam of the detector 66, causing the detector to emit an output signal to controller 47 which thereupon stops the splicer head drive motors 62a. The distance actually moved by the splicer head 36 is detected by an encoder 68 coupled to one of the pinions 62 as shown in FIG. 1.

Splicer head 36 carries, in addition to rollers 58, means in the form of a brush bar 72 or a resilient roller for pressing the running web W against the periphery of the ready roll 28 when the splicer head is in its advanced position shown in FIG. 2. The opposite ends of the bar or roller ar swingably supported to the splicer head side plates 36a by a pair of links 73. The bar or roller is movable between a retracted position shown in FIGS. 1 and 2 and an advanced or paste position against the running web W. The bar or roller may be moved between its two positions by actuators 74 whose armatures are connected to links 73.

Head 36 also supports a knife 76 which can be moved by actuators 77 mounted to the head side plates 36a between a retracted position shown in FIGS. 1 and 2 and an advanced or cutting position wherein it penetrates the running web W. Actuators 77 are also controlled by signals from controller 47.

Figure 4:
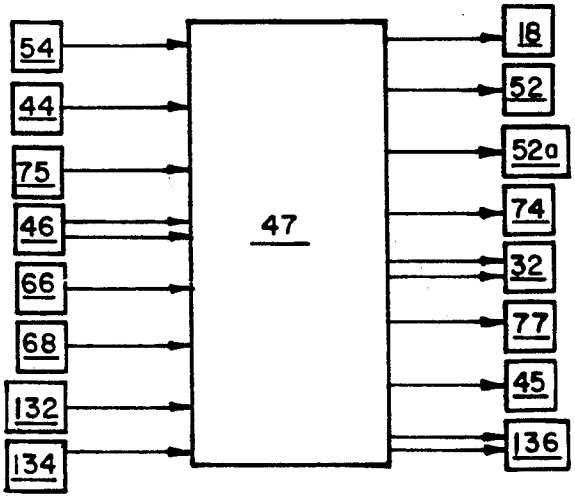
FIG. 4 is a block diagram of the controller in the FIG. 1 splicer, showing the controller's various input and output signals.

FIG. 4 shows the various detector signals to and control signals from controller 47. The controller also has various other inputs and outputs necessary for the proper operation of any turret splicer, but which do not bear on this invention.

Referring to FIGS. 2 and 4, when splicer 10 is operated to splice the leading end of the web on ready roll 28 to running web W, as soon as the running web roll 26 unwinds to a selected minimum diameter, a signal is applied to controller 47 indicating this fact. That signal may be generated by any means well known in the art. In response to that signal, the controller issues signals to accelerators 52 causing them to engage and rotate roll 28 which is now in the position shown in FIG. 2.

Roll 28 is accelerated to a selected nominal splicing speed in accordance with a selected acceleration ramp programmed into the controller. As noted above, this speed may be the normal line speed of the web consuming machine or a speed somewhat greater or less than line speed. During this acceleration time or beforehand, the controller also controls the splicer head drive motors 62a to move the splicer head toward the rotating ready roll 28 until the detector 66 on the splicer head senses the periphery of that roll. Since the roll is not an exact cylinder, its cylindrical surface may have high and low points. Therefore, the splicer head 36 is preferably advanced along rails 58 in small increments. e.g. $\frac{1}{8}$ inch, with roll 28 executing a full revolution between increments so that the detector 66 will detect the high point on the roll.

Figure 5:
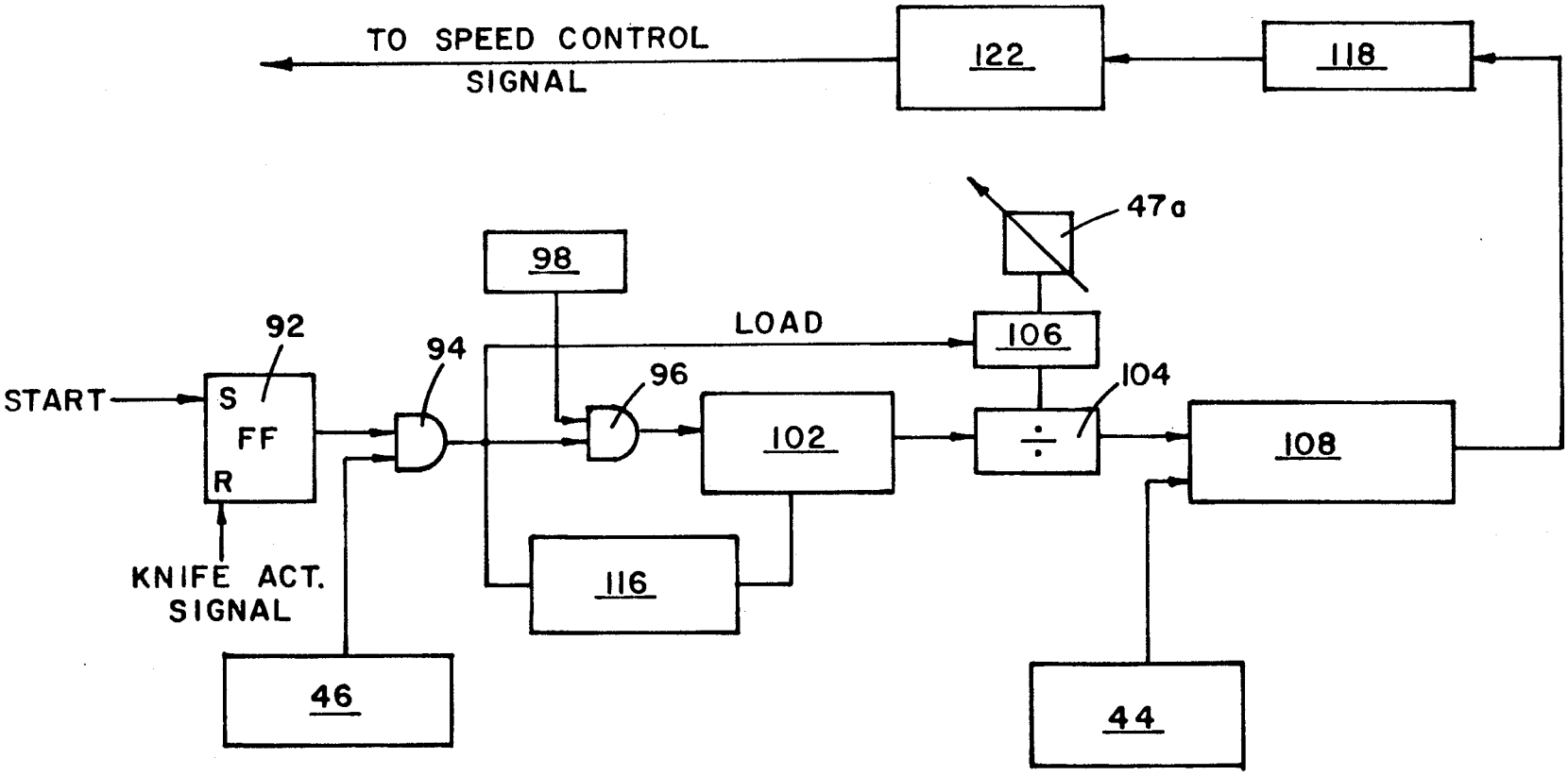
FIG. 5 is a block diagram of a functional circuit in the splicer controller.

In accordance with the invention, as roll 28 is accelerated to the splicing speed, the surface speed of the roll at the splice location thereon, i.e., at the tape T, is measured. In the illustrated splicer, the tape detector 46 produces an output signal whenever the tape T is opposite that detector. For example, the detector may be an optical detector that responds to light reflected by the tape. This signal is applied to controller 47 which includes a circuit such as shown in FIG. 5 for determining the surface speed of roll 28 at tape T and for comparing that speed with the speed of running web W to produce a speed difference signal. The difference signal is then applied by the controller to match the speed of the running web and the surface speed of the ready roll at the location of tape T thereon. For purposes of this description, we will assume that the ready roll speed is the speed reference and that the speed of the running web will be adjusted to achieve the speed match. Accordingly, the speed difference signal from the controller is applied to control the brake 32 for roll 26 letting off the running web W.

When a speed match is achieved, the next time the tape T advances to splicing location P, controller 47 issues a control signal to actuator 74 causing the bar 72 or roller to press the running web against the periphery of the ready roll.

After a selected member of signals from encoder 54 following the paste, controller 47 issues a control signal to the knife actuators 77 causing the knife 76 to sever the running web W just behind the splice thereby separating that web from its depleted roll core 26. From this point on, the web consuming machine draws its web requirement from the ready roll 28.

Controller 47 now returns the splicer head 36 to its retracted position shown in FIG. 1 and retracts and de-energizes the accelerators 52. At some later time, the controller actuates the turret motor 18 to raise the roll 28 from the floor to the same position occupied by roll 26 in FIG. 1, The core of the expired roll 26 can now be removed from the lower set of chucks 24 and a new ready web roll prepared for the next splice cycle.

A suitable circuit for determining the surface speed of roll 28 at tape T and performing the necessary comparison to achieve a speed match at that segment of roll 28 is shown in FIG. 5. It should be understood, however, that there are other ways for accomplishing the same objectives that can be envisioned by those skilled in the art after reading this disclosure.

After the roll 28 is accelerated to the nominal splicing speed, a START signal is applied to a flip flop 92. The resulting output signal from the flip flop is applied to a gate 94 which also receives the signal from the operative splicing tape detector 46. So long as the detector senses the presence of that tape T, it enables a gate 96 to pass pulses from a clock 98. Those gated pulses i.e., the pulses emitted during the on-time of detector 46, are counted in a counter 102 and that count is applied to a divider 104. Divider 104 divides that number into a number reflecting the width of tape T contained in a register 106, which number can be set by a control on the controller front panel 47*a*. The signal from gate 94 loads the register 106 number into the counter.

The output from divider 104, which represents the surface speed of roll 28 at tape T, is applied to a comparator 108. The other input to the comparator is the speed of running web W which is represented by the output of a tachometer 44 which monitors the speed of the guide roller 38. Counter 102 may be reset by the falling edge of the signal from gate 94 which is applied by way of a falling edge detector 116 to the reset input (R) of that counter. Thus, once each revolution of roll 28, as tape T passes opposite the detector 46, a comparison is made between the speed of the running web W and the surface speed of the roll 28 where the splice between the two webs is to occur, i.e., at tape T.

The comparator 108 produces an output number which is positive, negative or zero depending upon whether the running web W is faster, or slower than the roll 28 speed or has the same speed as the roll. That speed mismatch or difference number is applied via a register 118 to a D/A converter 122 to produce a speed control signal that may be applied to the brake 32 controlling the speed of the web roll 26 supplying the running web W. (and/or to accelerator roll 45). For example, if the number in register 118 is positive, indicating that web W speed is higher than the roll 28 surface speed, the signal from the converter may increase the braking force to slow down web W. On the other hand, if the web W is running too slow, the resulting converter output may reduce the braking force on that web W. After a few revolutions of roll 28, then, the surface speeds of the two webs should be matched. When the output from comparator 108 indicates a speed match, the next time tape T is advanced to the splicing station, the resulting signal from detector 46 triggers the actuation of brush or roll actuators 74 as described above to effect the actual splice.

Splicer 10 may be operated in more or less the same way to make a splice at a selected splicing speed less than line speed. For example, the line speed may be 3000 fpm with the splice being carried out at 1500 fpm. As before, the prepared ready roll 28, positioned as shown in FIG. 2, is accelerated up to the selected speed, e.g. 1500 fpm. In this case, controller 47 also applies control signals to the brakes 32 associated with the running roll 26 to decelerate that roll according to a desired deceleration ramp so that the running web W reaches the selected splicing speed at more or less the same time as, or later than, the surface of the ready roll 28. As before, the speed of the running web W is matched to the ready roll surface speed at the location of splicing tape T to achieve a precise speed match at the splicing location on the roll in a minimum length of time. While web W is drawn from roll 26 at the reduced speed, the web consuming machine draws its web requirements from the accumulator 42.

The splicer now functions in the same way described above to press the running web W against the ready roll. As soon as contact has been made and perhaps even before the actual paste, controller 74 de-activates the brake 32 retarding running roll 26 and controls drive roller 45 and accelerators 52 to accelerate both webs while they remain speed matched. As soon as the splice tape T next passes through splice location P, the two webs will be pasted together, following which the running web W may be severed as described above.

Acceleration of the ready roll 28 continues until the web being drawn from that roll reaches line speed. Actually, as noted above, the web from roll 28 may be accelerated to a speed somewhat greater than line speed in order to replenish accumulator 42 with substantially the same amount of web that was drawn out during the aforesaid splice cycle.

The measurement of ready roll speed at the location of the splice is even more preferably accomplished by applying a bar code label or similar indicia to the ready roll in the vicinity of the splicing tape or adhesive, as indicated at C in FIG. 3. Thus, if the tape or adhesive is applied in a V or W shape, the label may be located between the legs of the V or W. As the bar code advances past detector 46 (a laser source/detector in this case), the detector will detect the leading edges of the bars and emit a series of pulses to the controller 47. Once each revolution of the ready roll, controller 47 may compare the frequency of the signal from detector 46 with the output signal from tachometer 44 which reflects the speed of the running web. If the frequencies are different, the controller may issue a difference signal to control the braking of running roll 26 accordingly until a speed match is attained.

If the presence of a gap or gaps in the splice between the two webs is not a problem in a particular application, the present invention can even be practiced in a splicer which measures the surface speed of the ready roll by means of a conventional tachometer wheel which rides on the surface of the roll or which monitors the speed of the belts which accelerate the roll. In accordance with this invention, however, only the speed data corresponding to the roll surface speed at the location of the incipient splice is compared with the speed of the running web to obtain the speed match. In this way, a perfect match will result even if the roll has eccentricity or surface irregularities. In such an implementation, the splicing tape T or the bar code C is used as in FIG. 5 to gate the pulses from the tachometer monitoring the ready roll speed or the belt speed so that only those pulses which occur when the tape is opposite the detector 46 are compared with the pulses from the running web tachometer 44.

Still another known method of measuring ready roll surface speed is disclosed in my parent application. The shaft encoder 54 measures the angular velocity of the ready roll 28 and that velocity is multiplied by the roll radius, the radius being measured by the displacement of the splicing head 36 to its splicing position shown in FIG. 3. As discussed above, prior to splicing, the head moves in small increments toward ready roll 28 until a light source of detector 66 thereon is first intercepted by roll 28. This allows controller 47 to calculate the radius of roll 28 at the high point on the roll and thus the surface speed of the roll at that high point. However, as described at the outset, the roll radius and the speed there may or may not be the same as the radius and speed of the roll where splicing will occur, i.e., at tape T. Therefore, in accordance with this invention, the prior measurement procedure is modified so that only the roll radius and velocity data at the actual location of the splicing tape T is used for comparison with running web speed to arrive at a speed match. More particularly, when detector 66 emits a signal to controller indicating that the splicing head is in its advanced position i.e., the detector detected the high point on roll 28, the controller sends control signals to the head drive motors 62*a* causing those motors to further advance head 36 in smaller increments, e.g., 1/16 inch, until the detector 46 first detects that the tape T is at the splicing position P. The resulting signal causes controller 47 to disable the head motors and count the total number of pulses issued by the head encoder 68 since the head moved from its home position in FIG. 1 to compute the roll radius at tape T. The controller can now multiply that radius by the angular velocity of the ready roll as obtained from encoder 54 to determine the surface speed of roll 28 at tape T. That speed can then be compared to the speed of web W as measured by tachometer 44 to produce a speed difference signal for controlling the speed of web W to achieve a speed match at tape T, all as described above. The next time detector 46 detects the presence of tape T at location P, its output triggers the actuators 74 as described above.

As splicer 10 obtains a web speed match at the location of the splice to the ready web so also it matches the edge positions of the webs at the splice. For this, the splicer includes a conventional web edge detector or scanner 132 for monitoring the edge position of running web W when the turret is in its splicing position shown in FIG. 2. A similar detector or scanner 134 monitors the position of the edge of ready roll 28. Both detectors may be mounted to the splicer head 36 relative to which the web rolls 26 and 28 ma be shifted laterally by their carriages 22. As described in the above-identified application Ser. No. 695,705, electric motors 136 (FIG. 2) are provided to rotate lead screws (not shown) which move carriages 22 laterally on turret 14. By shifting the rolls in this way, one may adjust the lateral positions of the webs in the press or other downstream web consuming machine. To bring the two webs into edge alignment, either one of the webs, e.g., web W, may be used as reference. With the lateral position of web W fixed, the outputs of the two detectors or scanners 132,134 may be compared to produce an edge position error signal. As is well known in the art, that error signal may be used to control the motor 136 which moves the carriage 22 supporting ready roll 28 to adjust the side lay of roll 28 so as to bring the two webs into edge alignment.

In the present case, however, to avoid mispositioning problems due to irregularities in the roll 28 discussed above, the edge of the running web and the edge of the roll 28 right at the place of splicing are aligned. For this, the output of the detector 46 is used to gate the output of roll edge detector 134 so that only the arcuate roll edge segment underlying tape T is used for position comparison with the edge of the running web W. Resultantly, the edges of the two webs will be in perfect alignment at the time and place of splicing even if the ends of roll 28 have an appreciable wobble.

It will thus be seen that the objects set forth above, among those made apparent from the preceding description, are efficiently attained. Also, certain changes may be made in carrying out the above method and in constructions set forth without departing from the scope of the invention. For example, detector 46 may look at the ready roll other than at splicing location P. More particularly, the outputs of detector 46 and encoder 54 allow the tracking of the instantaneous position of tape T about the roll 28 axis. It is feasible then, to bring the two webs together before the tape T reaches splicing location P as described in my parent application so long as that does not alter the angular velocity of the ready roll or result in stretching of the webs, i.e., so long as the webs can slip. Therefore, it is intended that all matter contained in the above description or shown in the accompanying drawings shall be interpreted as illustrative and not in a limiting sense.

I claim:

1. A method of splicing a running web to the web on a ready roll comprising the steps of:

a. applying an adhesive splicing medium to the leading end of the web on the ready roll;

b. accelerating said ready roll;

c. determining the circumferential surface speed of said ready roll proximate the splicing medium without contacting said ready roll by:

1. measuring the circumferential extent of the adhesive medium;
2. measuring the time that it takes said medium to pass by a selected fixed point opposite said roll surface during each revolution of said roll; and
3. dividing said extent by said time to produce a value indicative of the surface speed of the roll in the vicinity of said splicing medium;

d. determining the speed of the running web;

e. comparing the running web speed and the ready roll surface speed in the vicinity of the splicing medium during seccessive revolutions of the roll to produce speed difference signals;

f. applying the difference signals to control the speed of the running web and/or the ready roll to match the speed of the running web and the surface speed of the ready roll in the vicinity of the splicing medium; and g. touching the running web to the surface of the ready roll after achieving said speed match to effect a splice.

2. Apparatus for splicing a running web to the web on a ready roll having an adhesive splicing medium on the leading end of the web on the ready roll, said apparatus comprising:

a. means for accelerating said ready roll without contacting said ready roll;

b. means for measuring the circumferential surface speed of said ready roll proximate the splicing medium including:
1. means for determining the circumferential extent of the adhesive medium;
2. means for determining the time that it takes said medium to pass by a selected fixed point opposite said roll surface during each revolution of said roll; and
3. means for dividing said extent by said time to produce a value indicative of the surface speed of the roll in the vicinity of said splicing medium;

c. means for measuring the speed of the running web;

d. means for comparing the running web speed and the ready roll surface speed in the vicinity of the splicing medium during successive revolutions of the roll to produce speed difference signals;

e. means for applying the difference signals to control the speed of the running web and/or the ready roll to match the speed of the running web and the surface speed of the ready roll in the vicinity of the splicing medium; and f. means for touching the running web to the surface of the ready roll after achieving said speed match to effect a splice.

* * * * *